US006113334A

United States Patent [19]

Riva

[11] Patent Number: 6,113,334

[45] Date of Patent: Sep. 5, 2000

[54] MANOEUVRE EQUIPMENT FOR RODS USED IN DRILLING PLANTS

[75] Inventor: Giovanni Riva, Rapallo, Italy

[73] Assignee: Soilmec SpA, Cesana, Italy

[21] Appl. No.: 09/099,992

[22] Filed: Jun. 19, 1998

[30] Foreign Application Priority Data

Jun. 20, 1997 [IT] Italy ..... T097A0539

[51] Int. Cl.[7] ..... E21B 09/15

[52] U.S. Cl. ..... 414/22.63; 175/52; 175/85

[58] Field of Search ..... 175/52, 85, 161, 175/162; 414/22.51, 22.63, 22.64, 22.65, 22.66, 22.67, 22.68, 22.71

[56] References Cited

U.S. PATENT DOCUMENTS

| | | | |
|---|---|---|---|
| 3,443,647 | 5/1969 | Jenkins et al. . | |
| 3,768,663 | 10/1973 | Turner, Jr. et al. | 175/85 |
| 3,851,770 | 12/1974 | Jenkins et al. . | |
| 4,020,909 | 5/1977 | Airaudo . | |
| 4,036,508 | 7/1977 | Eddy et al. . | |
| 4,274,778 | 6/1981 | Putnam et al. | 175/85 |
| 4,434,860 | 3/1984 | Deyo . | |
| 4,440,536 | 4/1984 | Scaggs | 175/85 |
| 4,709,766 | 12/1987 | Boyadjieff | 175/52 |
| 4,715,761 | 12/1987 | Berry et al. | 175/85 |
| 4,862,973 | 9/1989 | Voigts et al. | 175/52 |
| 4,899,832 | 2/1990 | Bierscheid et al. | 175/85 |
| 5,244,329 | 9/1993 | McGill et al. | 414/22.63 |
| 5,375,667 | 12/1994 | Trevasani . | |

FOREIGN PATENT DOCUMENTS

| | | | |
|---|---|---|---|
| 1170016 | 7/1984 | Canada . | |
| 0548900 | 6/1993 | European Pat. Off. . | |
| 2092611 | 1/1972 | France . | |
| 2644508 | 9/1990 | France . | |
| 3520084 | 12/1985 | Germany | 175/52 |
| 1121381 | 10/1984 | Russian Federation . | |
| 1460186 | 2/1989 | Russian Federation . | |
| 2079817 | 1/1982 | United Kingdom . | |
| 2083106 | 3/1982 | United Kingdom . | |

*Primary Examiner*—Gregory A. Morse
*Attorney, Agent, or Firm*—Merchant & Gould P.C.

[57] ABSTRACT

Description of a manoeuvre equipment for rods (20) used in drilling plants, operating between an equipment for rod stowage (22, 23), where lines of rods are stowed vertically, and a service well (24) from which each single rod (20) can be taken out, and in which each single rod can be placed in, by means of a mobile motive head of the drilling head of the plant. The manoeuvre equipment includes a column (1). rotating on its vertical axis (a); the column supports, rotating rigid with it: pliers (7) to lock a single rod (20); one saddle (6) to translate the pliers (7) according to a vertical axis parallel to the (a) axis; one horizontal arm, sliding inside the saddle (6), that translates the pliers (7) according to a horizontal axis perpendicular to the (a) axis; means (9, 10, 21) to adjust the verticality of the rod (20) locked by the pliers (7).

4 Claims, 2 Drawing Sheets

MANOEUVRE EQUIPMENT FOR RODS USED IN DRILLING PLANTS

DESCRIPTION

The present invention relates to a manoeuvre equipment for rods used in soil drilling plants.

DESCRIPTION OF THE STATE OF THE ART

One of the systems currently used to mount single rods on the rod string, consists in making, next to the drilling hole, a service well from which a new drilling rod to be fixed on the motive head of the plant is cyclically taken. The head is then lifted upwards together with the new rod and placed again in axis with the drilling hole, the new drilling rod is connected to the rods already operating and the drilling of a new portion of the same length of the newly mounted rod is started.

From the Italian Patent Application for the Utility Model n°TO92U000228, on behalf of the same Petitioner, it is known an equipment to stow and manoeuvre rods for soil drilling plants which include a drilling tower with motive head that moves between a drilling hole and one service well used to take and place the drilling rods. Such equipment includes a rigid base to which the feet of a plurality of rod containers are pivoted. In such equipment a single jib crane, mounted on the drilling plant, is used, said jib crane holding, by means of a cable, a device to fasten the rods and their containers. The same jib crane is used both to overturn the containers on a vertical plane between a basically vertical operation position and a laying position for mounting and dismounting, and to take the rods out from the containers.

The containers are made of lattices presenting a comb-shaped cross section defining a plurality of compartments opened towards the drilling plant and where rod strings are tidily stowed.

Such known equipment works in the following way: the containers, full of drilling rods, are first laid on the ground, by placing their feet on the external edge of the base and then rotatably secured to it on a vertical plane. The lattice containers are then lifted in their vertical operation position by the service crane. When the containers are in their upright position their front feet are also locked on the base by means of fast locking means.

At this point the jig crane carries the fastening device in correspondence with one of the rods contained in one container; an operator locks manually the rod to the fastening device so that it is taken out from the container by the crane. The crane then rotates round the drilling tower and places the rod into a service well from which the rod is taken by the motive head of the drilling plant so that it is placed in axis with the vertical at the centre of the drilling hole, where it is screwed on the rod string already operating. An opposite manoeuvre is needed to take the rod string out from the hole.

This type of equipment allows good handling of the rods yet it presents the inconvenience that the presence of an operator is needed in order to manually fasten, to the fastening device of the crane, each single rod that is to be taken out from the container, and to watch closely how the rod that is hanging from the cable of the crane in inserted into the service well. It is easily understood that the task of said operator is quite unsafe since a rod could fall accidentally on him or hit him.

ABSTRACT OF THE INVENTION

It is an object of the present invention to provide an improved and mechanised rod-manoeuvring equipment that can make the above mentioned operations simpler and more accurate, improve the overall performance of the drilling plant and increase security in the site.

This as well as others objects and advantages, that will become more clear later on, are achieved by the present invention of a manoeuvre equipment for rods, characterised in that it includes one column rotating on its vertical axis, said column supporting, rotating rigid with it:

- at least one pliers means to lock a single rod;
- means to translate said pliers means according to a vertical axis parallel to the axis of the column;
- means to translate said pliers means according to a horizontal axis basically perpendicular to the axis of the column;
- means to adjust the verticality of the rod locked by said pliers means.

DESCRIPTION OF THE DRAWINGS

The structural and functional characteristics of one preferred non-restrictive embodiment of the equipment according to the present invention are now illustrated with reference to the appended drawings, in which.

DESCRIPTION OF ONE PREFERRED EMBODIMENT

Figure 1:
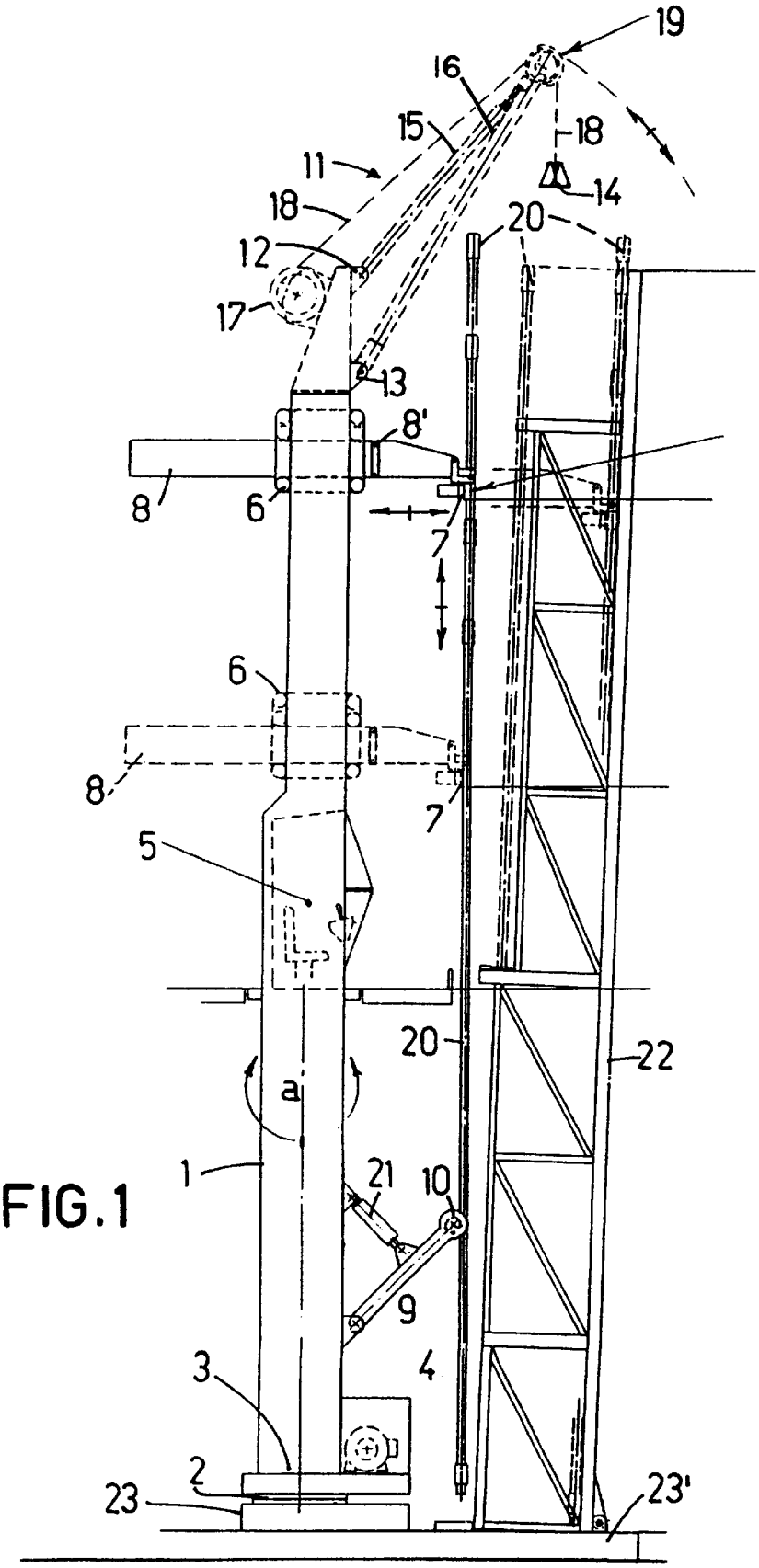
FIGS. 1 and 2 are, respectively, an elevation side view and a plan view of a manoeuvre equipment for rods according to the present invention.

With reference to FIG. 1, number 1 indicates the vertical column 1, provided with its own base 3 rotating on a vertical axis a; on the base 3, near the foot of the column, it is also secured an electrohydraulic gearcase 4 with its relative oil tank and electric control panel. An horizontal fifth wheel 2, coaxial to the axis a, is placed vertically between the rotating base 3 and a fixed base 23 rigidly fixed to the rigid base 23' to which the lattice containers 22 for the drilling rods 20 are secured all around the rotation axis a of the column, as described in the mentioned Patent Application for Utility Model n° TO92U000228.

A cabin 5 for the operator is located at nearly half the height of the column 1.

Along the vertical column 1 slides a saddle 6 that supports in horizontally sliding way a horizontal arm 8 on the end of which—and facing the containers 22—there are the hydraulic clamping pliers 7 to fasten each rod 20 that is to be manoeuvred.

In the lower part of the column 1, on its side that faces the rod containers 22 while operating, there will be an adjusting device to keep the rods in their vertical position while they are moved, as described later on. The adjustment device includes an idle roller 10 mounted on the free end of one arm 9 the other end of which is pivoted to the column 1 so that it can oscillate in the vertical plane passing through the a axis of the column. An hydraulic cylinder 21 is connected to the arm 9 at a point half way from its two ends as well as to the column 1.

At the top of column 1 there is a jib crane, overall indicated by 11, rotatably integral with the column. The crane includes a rigid arm 16, pivoted to the column around a horizontal pivot 13, as well as an hydraulic cylinder 15 pivoted on the column 1 by means of a second horizontal pivot 12, in order to make the arm 16 rotate in the vertical plane passing through the a axis of the column.

At the free end of the arm 16 there is a pulley 19 where a cable 18 slides, being means for fastening 14 secured at its end in order to fasten the rods 20 separately. The crane 11 includes a coiler 17 that controls the sliding of the cable and consequently the lowering and lifting of the means for fastening 14. The crane can serve as auxiliary means for conventionally handle the rods in case the means that move the hydraulic pliers 7 are out of service as well as to lift and displace different loads. In this case the position on top of the rotating column is of use since from that position it is possible to reach the rods inside the containers very easily.

The equipment works as follows: in order to take one rod 20 out from one of the lattice containers 22, the operator inside the cabin 5, first lifts the saddle 6 along the column 1 so that the pliers 7 are carried high enough to allow the lifting of the selected rod from its container, and in doing this, the operator will not lift the saddle 6 up to its upper end of stroke, but he will leave a minimum stroke in order to allow an additional lifting once the rod has been fastened. The operator then makes the column rotate on the vertical axis a when he wants to take a rod. After that, the arm 8 slides horizontally and extends radially outside until it fastens the selected rod 20; at this moment the jaws of the pliers 7 close and lock the rod. After the rod is locked it is lifted by means of an additional lifting of the saddle 6 so that the locked rod is kept hanging while the horizontal arm 8 is drawn back towards the central column. On the arm 8 there is a stop 8' the distance of which from the pliers 7 is such that when the stop 8' actuates the lower part of the rod taken will lay against the roller 10 and will be placed in a perfectly vertical position, as shown in FIG. 1.

Figure 2:
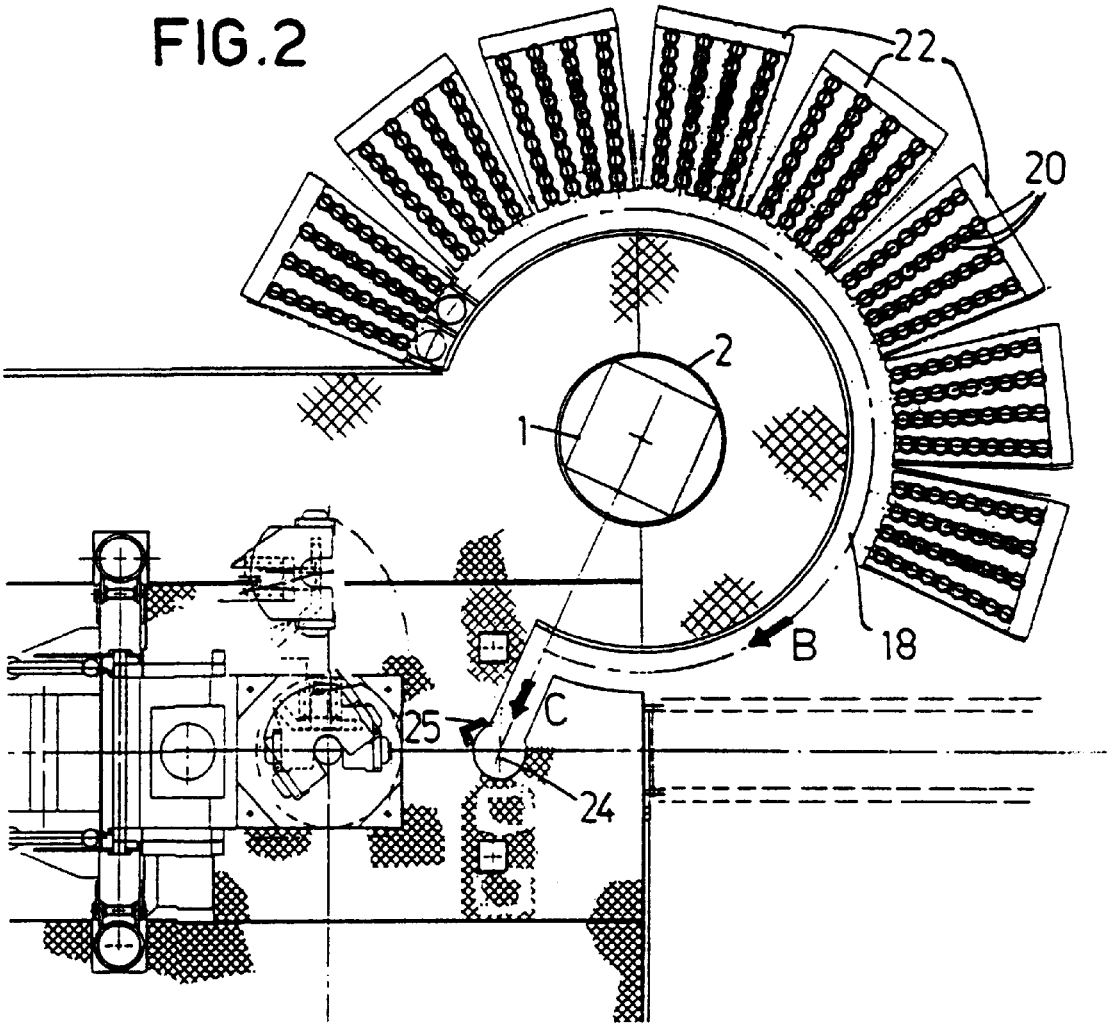

With reference to FIG. 2, the column 1 with the rod hanging vertically is rotated in the direction indicated by arrow B towards the service well 24 and then the arm 8 is again extended outwards (as indicated by arrow C) so that the rod is positioned in axis with the well 24, while, at the same time, the hydraulic cylinder 21 is extended in order to make the roller 10 keep the rod vertical.

The saddle 6 is then lowered in order to introduce the lower part of the rod into the service well. In correspondence with it there is a vice 25 which locks the rod inside the well into a vertical position. The jaws of the pliers 7 are then opened and the rod is released. At this point the pliers 7 are moved back towards the column by drawing back the horizontal arm 8 while the cylinder 21 is also drawn back thus taking back both the arm 9 and the roller 10 towards the central column 1.

The rod 20, finally ready to be taken by the motive head (not shown) of the drilling plant, is positioned in axis with the rod string already operating in the drilling hole (not shown) and coupled to it.

In order to place again into the containers any single rod taken out from the drilling hole, a manoeuvre opposite to the one previously described is performed.

As it can be noticed, the equipment of the present invention allows a tidy and fast mounting and dismounting of the rods during the manoeuvres of both hole drilling and withdrawing after completion of the well. The mechanisation of rod manoeuvring increases safety in the operations performed to take the rods out of, as well as to replace them into, their containers.

Finally, it must be noticed that programmable control means make it possible to automatically control the entire, or at least part of, sequence of rod manoeuvring operations, so that the need for human intervention as well as the possibilities of any errors are reduced to the minimum degree.

What is claimed is:

1. Manoeuvre equipment for rods used in drilling plants, operating between an equipment for rod stowage and a service well from which each single rod can be taken out, and in which each single rod can be placed in, by means of a mobile motive head of the drilling tower of the plant, the stowage equipment including a plurality of containers defining a plurality of compartments opened towards the manoeuvre equipment and in which rod strings are tidily stowed in a vertical position, the manoeuvre equipment including one column rotating on a vertical column axis and the column, supporting rotatably integral with it, comprising:

at least one pliers means to lock a single rod;

means for translating said pliers means according to a vertical axis parallel to the column axis;

means for translating said pliers means according to a horizontal axis substantially perpendicular to the column axis;

means for adjusting the verticality of the rod locked by said pliers means; and a cabin for an operator supported by and rotatably integral with the column;

wherein said cabin is located at approximately half the height of the column.

2. Manoeuvre equipment for rods used in drilling plants, operating between an equipment for rod stowage and a service well from which each single rod can be taken out, and in which each single rod can be placed in, by means of a mobile motive head of the drilling tower of the plant, the stowage equipment including a plurality of containers defining a plurality of compartments opened towards the manoeuvre equipment and in which rod strings are tidily stowed in a vertical position, the manoeuvre equipment including one column rotating on a vertical column axis and the column, supporting rotatably integral with it, comprising:

at least one pliers means to lock a single rod;

means for translating said pliers means according to a vertical axis parallel to the column axis;

means for translating said pliers means according to a horizontal axis substantially perpendicular to the column axis; and means for adjusting the verticality of the rod locked by said pliers means, wherein said adjustment means are located on the column below said pliers means for engaging the lower part of the rod there locked; and wherein said adjustment means for adjusting the verticality of the rod further comprise:

at least one idle roller mounted on the free end of one arm the other end of which is pivoted to the column so that it oscillates in the vertical plane passing through the column axis; and at least one hydraulic cylinder connected to the arm at a point half way from its two ends as well as to the column.

3. Manoeuvre equipment for rods used in drilling plants, operating between an equipment for rod stowage and a service well from which each single rod can be taken out, and in which each single rod can be placed in, by means of a mobile motive head of the drilling tower of the plant, the stowage equipment including a plurality of containers defining a plurality of compartments opened towards the manoeuvre equipment and in which rod strings are tidily stowed in a vertical position, the manoeuvre equipment including one column rotating on a vertical column axis and the column, supporting rotatably integral with it, comprising:

at least one pliers means to lock a single rod;

means for translating said pliers means according to a vertical axis parallel to the column axis;

means for translating said pliers means according to a horizontal axis substantially perpendicular to the column axis;

means for adjusting the verticality of the rod locked by said pliers means; and a jib crane provided with coiling means for moving a cable with means for fastening the rods, said jib crane disposed on top of the column and being supported by the column.

4. Manoeuvre equipment according to claim 3, wherein said jib crane further comprises a rigid arm oscillating in the vertical plane passing through said column axis by means of a hydraulic cylinder.

* * * * *